US005465966A

United States Patent [19]

La Savio

[11] Patent Number: 5,465,966

[45] Date of Patent: Nov. 14, 1995

[54] STREET OR COURT HOCKEY PUCK

[76] Inventor: Michael La Savio, 4506 Ellenwood Dr., Eagle Rock, Calif. 90041

[21] Appl. No.: 104,180

[22] Filed: Aug. 9, 1993

[51] Int. Cl.[6] ..... A63B 71/00

[52] U.S. Cl. ..... 273/128 R

[58] Field of Search ..... 273/128 R, 128 A, 273/128 CS

[56] References Cited

U.S. PATENT DOCUMENTS

| | | | |
|---|---|---|---|
| 3,997,164 | 12/1976 | White, Sr. | 273/128 R |
| 4,078,801 | 3/1978 | White, Sr. | 273/128 R |
| 4,111,419 | 9/1978 | Pellegrino | 273/128.4 X |
| 4,153,253 | 5/1979 | White, Sr. | 273/128 R |

FOREIGN PATENT DOCUMENTS

| | | | |
|---|---|---|---|
| 2506181 | 8/1976 | Germany | 273/128 CS |

*Primary Examiner*—Raleigh W. Chiu
*Attorney, Agent, or Firm*—Wagner & Middlebrook

[57] ABSTRACT

An improved hockey puck particularly for street or court play. The puck has a cylindrical body and includes on its pair of planar faces at least one cushioned disk extending above the face surface and acting as the sliding surface for the puck. Angular e.g. vertical forces applied to this puck are absorbed by the cushion allowing the puck to slide with a minimized tendency to roll. In one embodiment, a single disk is located on each face. In another embodiment, a plurality such as three disks are present, each cushioned by an O ring. In other embodiments, an inertial member is rotatably or flexurally mounted along the central axis of the cylindrical body.

9 Claims, 1 Drawing Sheet

FIG. 1
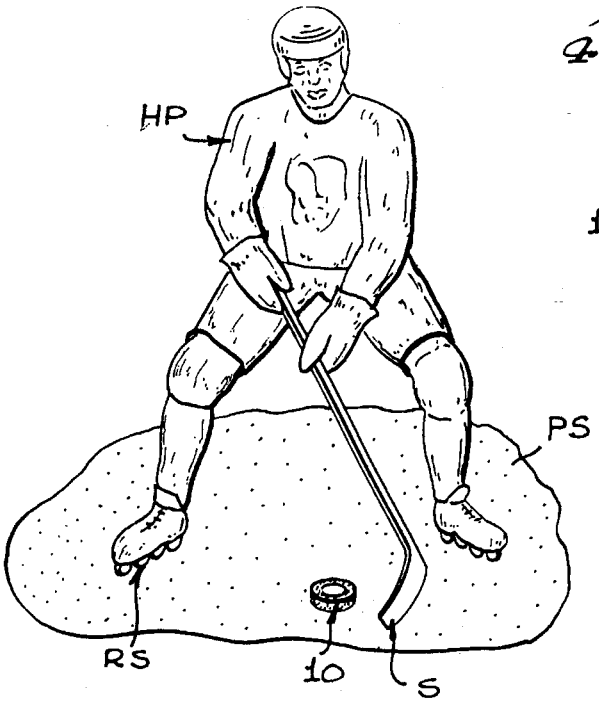
FIG. 2
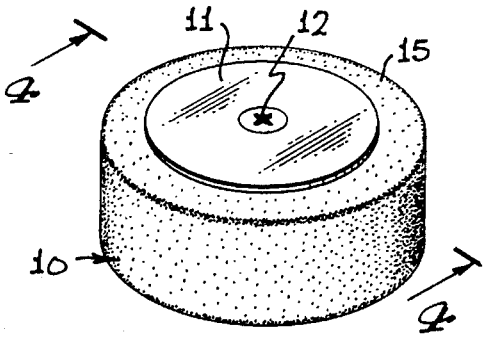
FIG. 3
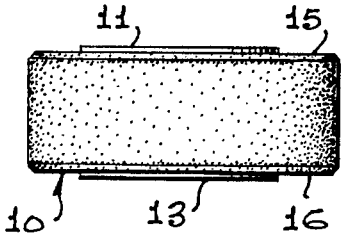
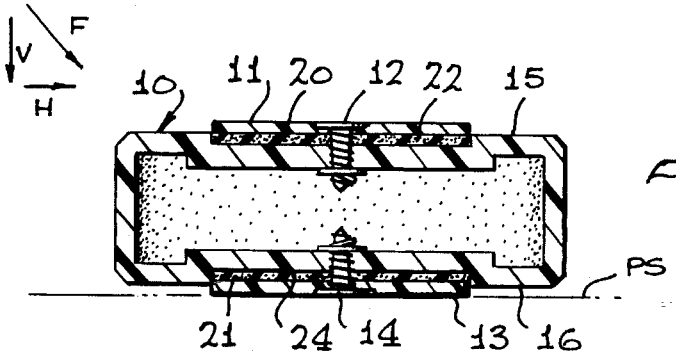
FIG. 4
FIG. 5
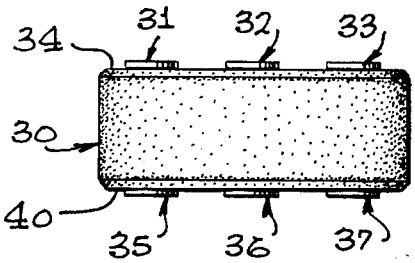
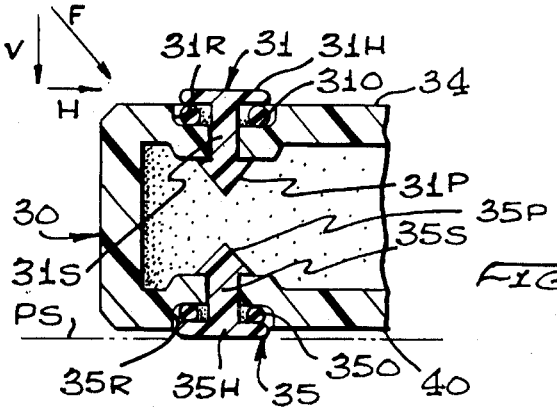
FIG. 6

STREET OR COURT HOCKEY PUCK

FIELD OF THE INVENTION

This invention relates to the game of hockey, particularly when played using roller skates on either streets or surfaces other than ice.

BACKGROUND OF THE INVENTION

In recent years the sport of hockey has expanded tremendously when adapted to year round play on streets or outdoor or indoor courts wherein the players wear roller skates. The skates worn are either of the conventional two truck side by side skates or the more recently popular in-line wheeled skates. In particular, the in-line wheeled skates provide action for the skater similar to ice skates and it is believed that this similarity has given rise to adaptation of ice hockey with conventional sticks and a similar shaped hockey puck to the ice hockey puck. There are a few significant differences between the ice hockey puck and the street or court puck. The ice hockey puck is a cylinder normally made of a solid piece of rubber-like material weighing in the order of 6 ounces. In use, the ice hockey puck glides across a very slippery surface of a ice rink. With a powerful blow by a skilled player, the ice hockey puck can easily travel the entire length of an ice rink because of the low friction surface on which it rides.

The street or court hockey puck, however, slides on a surface which is distinctly less slick and can encounter pebbles or other discontinuities which interfere with distance and smooth travel. As a result, typical street hockey pucks are significantly lighter in weight than ice hockey pucks, an example, 3 ounces and often have rounded edges with the hope and expectation that the rounded edges will aid in the predictable travel. As a regular street hockey player, I have been less than satisfied with existing pucks. If the puck has a flat surface, even though it is light, the frictional engagement is such that the travel of the puck is limited. If it has sharp edges and a flat surface, there is a tendency for the puck to up-end and roll in an unruly and irksome fashion, causing poor puck behavior and general player consternation. If the edges are curved to minimize the interference with obstructions or defects in the playing surface, the tendency to up-end and roll may be even greater. Various attempts have been made to improve street hockey pucks as are typified by the following patents:

| | | |
|---|---|---|
| 4,754,973 | Kunick, P. | July 5, 1988 |
| 4,793,769 | Dolan, M. | December 27, 1988 |
| 4,878,668 | Nevorol, V. | November 7, 1989 |

BRIEF DESCRIPTION OF THE INVENTION

I have approached the problem of excess friction and the problem of the tendency of street hockey pucks to roll. As a result, I have produced a number of versions of street or court hockey pucks which provide improved play, minimizing friction and minimizing the tendency to roll.

In the first embodiment, a single large low friction disk-like member is secured to top and bottom of the puck body extending slightly above its main faces. Positioned in a recess beneath the disk is a resilient cushion which is compressed slightly in response to any vertical force exerted upon the puck which otherwise would tend to up-end the puck. The disk is able to slightly collapse the resilient cushion and absorb any vertical component of force caused by surface defect or puck descent. The net results are that the corner or edge of the puck may never touch the playing surface and thus not catch and roll. The resilient member will absorb much of the vertical up ending force.

In the second embodiment, the single disk is replaced by the plurality, for example, three button like projections, each of which have a circular o-ring like resilient member beneath the buttons. The buttons again present a low friction surface on which the puck rests and the resilient members can absorb any vertical component of travel by compression, minimizing the tendency to have the puck tip on end and roll. Also, the buttons may act independent of one another adding to stability of the puck.

In the third embodiment, I have reduced the rolling mass in the event that the puck does rise into a rolling position. The puck does include an internal rotatably mounted inertia member of resilient material on a central bearing with the majority of the weight of the puck residing in the bearing and inertia member.

BRIEF DESCRIPTION OF THE DRAWING

This invention may be more clearly understood from the following detailed description and by reference to the drawing in which:

FIG. 1 is a perspective view of a street or court hockey player employing the puck of this invention:

FIG. 2 is a perspective view of the first embodiment of this invention;

FIG. 3 is a side elevational view of the puck of FIG. 2:

FIG. 4 is a diametrical sectional view of the puck of FIG. 2 taken along the line 4—4 of FIG. 2;

FIG. 5 is a side elevational view of the second embodiment of this invention;

FIG. 6 is a fragmentary sectional view through an edge region of the embodiment of FIG. 5 showing one pair of the support button members;

DETAILED DESCRIPTION OF THE INVENTION

Referring now to FIGS. 1–4, wherein FIG. 1 shows a hockey player HP wearing a pair of in-line roller skates RS with a conventional hockey stick S employing a puck generally designated 10 incorporating the invention of FIGS. 2–4. As can be seen in FIG. 1 and better in FIGS. 2–4, the puck 10 is a hollow cylindrical plastic or rubber body having a slightly protruding disk 11 on its upper surface secured by such means as a screw 12. The disk 11 is matched by a similar disk 13 on its undersurface secured by a similar screw 14 to the opposite side of the puck 10. The disks 11 and 13 clearly extend above the plane of surfaces 15 and 16, respectively, of the puck 10. The disks 11 and 13 actually rest in respective depressions 20 and 21 in the otherwise planar surfaces 15 and 16. Typically these depressions are in the order of 2¼ inch in diameter and ⅜ inches in depth in a puck having a diameter of 3 inches.

Positioned beneath the disks 11 and 13 are resilient cushions 22 and 24. The disks 11 and 13 are free to move upward and downward along the shank of their respective screws. The screws 12 and 14 are countersunk an amount sufficient that when the disks 11 and 13 are fully depressed, the heads of the screws 12 and 14 do not extend above the surface. As illustrated in FIG. 4, the puck 10 is subject on occasion to be driven with a force, F having a vertical component V by the hockey stick, surface discontinuity, or if it happens to have been elevated, upon landing. In either case, where the puck is fiat on the playing surface, the vertical force is absorbed by the resilient member 24 and as illustrated in FIG. 4, where the resilient pad 24 is compressed to a smaller thickness than that of its counterpart 22. Absorbing this energy tends to limit the possibility of the puck being up ended and rolling.

I have developed another embodiment of this invention illustrated in FIGS. 5 and 6 which has certain advantages of simplicity of manufacture and eliminates any metal parts such as the screws 12 and 14 of the embodiment of FIGS. 2–4 as well as allowing each button to behave independent of the others. In the case of the puck, generally designated 30, of FIGS. 5 and 6, there are a plurality of buttons, for example, three, 31, 32, and 33 in one planar surface 34 and an additional number of buttons 35, 36 and 37 in the opposite planar surface 40 of the puck 30. These buttons each rest in a respective recess of which recesses 31R and 35R are shown in FIG. 6. The buttons 31–37 are similar to certain upholstery buttons in that they have a head, a shank, and a point. In the drawing FIG. 6, these components for button 31, 31H, 31S, 31P and 35, 35H, 31S, 31P are illustrated and the comparable parts of buttons 32–34 and 36 and 37 do not appear in the drawing but are identical in structure to those showing in FIG. 6 for buttons 31 and 35. Positioned beneath the head of each button is a resilient member, preferably in the form of an O-ring, 31 O and 35 O. In FIG. 6, the O-ring 35 O is shown compressed as the puck 30 is subject to a vertical component V as indicated by the downward arrow while the O-ring 37 O remains uncompressed. The O-rings 310–37 O are selected with a shore hardness in the order of 25–55 on the OO shore scale in order to provide sufficient resilience. The size of the heads such as 31 H and 35H is sufficient that with full compression they still remain above the surfaces 34 or 40 and the heads only have frictional contact with the playing surface PS. This minimizes frictional contact between the playing surface PS and the puck 30. A suitable material with good mechanical strength for the buttons 31–37 is nylon or polyacetyl resin. Preferred is nylon 6—6 with a molybdenum disulfide filler.

The above described embodiments of the present invention are merely descriptive of its principles and are not to be considered limiting. The scope of the present invention instead shall be determined from the scope of the following claims including their equivalents.

What is claimed is:

1. A roll resistant hockey puck for use on a playing surface comprising a body having a cylindrical edge surface and a pair of generally planar faces;

at least one depression formed in each of said faces;

axially movable members in said depression having an area less than the total area of each said planar face; and resilient members in said depression urging said axially movable members outwardly of said depression and permitting said axially movable members to move toward said body to absorb energy having a component normal to said planar faces.

2. A hockey puck as claimed in claim 1 wherein said axially movable members are disk members.

3. A combination in accordance with claim 1 wherein said axially movable members comprise a plurality of said members located around each of the faces of said body to provide support for the faces off of said playing surface and wherein each of said axially movable members is movable independently of all other said axially movable members.

4. A combination in accordance with claim 2 wherein fastening means including additional resilient means are provided fastening said disk members to said body.

5. A combination in accordance with claim 1 wherein said resilient means comprises a resilient cushion beneath each disk member.

6. A combination in accordance with claim 3 wherein said disks are three in number on each said face.

7. A combination in accordance with claim 1 wherein said resilient members comprise O rings.

8. A combination in accordance with claim 1 wherein said axially movable members comprise a plurality of buttons each including a head, a shank, and means securing said head to said body and said resilient means comprises an O ring located between said head and said body and extending around the shank of the button.

9. A roll resistant hockey puck comprising a body having a cylindrical edge surface and a pair of generally planar faces, at least one depression formed in each of said faces;

axially directed ports located in the bottom of each said depression;

a button member located in each said depression, said button member including a shank extending through said port and means securing said button member to said body; and resilient means positioned in said depression between said buttons and said body urging said buttons outwardly of said depression and permitting said buttons to move toward said body to absorb energy having a component normal to the faces of said body.

* * * * *